US008512609B2

(12) United States Patent
Schnabel et al.

(10) Patent No.: US 8,512,609 B2
(45) Date of Patent: Aug. 20, 2013

(54) WEB-PROCESSING MACHINE AND METHOD FOR THE CONTROL THEREOF

(75) Inventors: Holger Schnabel, Veitshoechheim (DE); Stephan Schultze, Lohr-Wombach (DE)

(73) Assignee: Robert Bosch GmbH, Stuttgart (DE)

( * ) Notice: Subject to any disclaimer, the term of this patent is extended or adjusted under 35 U.S.C. 154(b) by 163 days.

(21) Appl. No.: 12/989,768

(22) PCT Filed: Apr. 4, 2009

(86) PCT No.: PCT/EP2009/002493

§ 371 (c)(1), (2), (4) Date: Nov. 18, 2010

(87) PCT Pub. No.: WO2009/132748

PCT Pub. Date: Nov. 5, 2009

(65) Prior Publication Data

US 2011/0062205 A1 Mar. 17, 2011

(30) Foreign Application Priority Data

Apr. 29, 2008 (DE) ..... 10 2008 021 445

(51) Int. Cl.
*B65H 23/18* (2006.01)

(52) U.S. Cl.
USPC ..... 264/40.7; 226/44

(58) Field of Classification Search
CPC ..... B65H 23/1888
USPC ..... 264/40.7; 226/44
See application file for complete search history.

(56) References Cited

U.S. PATENT DOCUMENTS

| | | | | |
|---|---|---|---|---|
| 3,335,928 | A * | 8/1967 | Angell | 226/39 |
| 4,920,621 | A * | 5/1990 | Metzen | 26/18.6 |
| 7,798,382 | B2 * | 9/2010 | Zentgraf et al. | 226/44 |

FOREIGN PATENT DOCUMENTS

| | | |
|---|---|---|
| DE | 2328154 | 1/1974 |
| DE | 3605168 | 8/1986 |
| DE | 10322098 | 12/2004 |
| DE | 102005056802 | 5/2007 |
| EP | 0737638 | 10/1996 |
| WO | 9210491 | 6/1992 |

OTHER PUBLICATIONS

International Search Report, PCT/EP2009/002493, corresponding to U.S. Appl. No. 12/989,768, Jul. 7, 2009.

* cited by examiner

*Primary Examiner* — Yogendra Gupta
*Assistant Examiner* — Alison Hindenlang
(74) *Attorney, Agent, or Firm* — Hodgson Russ LLP

(57) ABSTRACT

A method for operating a web-processing machine having at least one first driven transport roller (2) that transports a material web (10), at least one second transport roller (4) that transports the material web (10), and at least one treatment unit (8) that treats the web, at least one transport roller (2, 4) comprising a drive device (12, 14), and at least one drive device (12) being controlled by a control device (20), and control of said drive device (12) being accomplished as a function of elongation properties of the material web (10), such that when taking into account the elongation properties of the material web (10), a damping of said elongation properties is also taken into account.

16 Claims, 2 Drawing Sheets

Figure 3A:
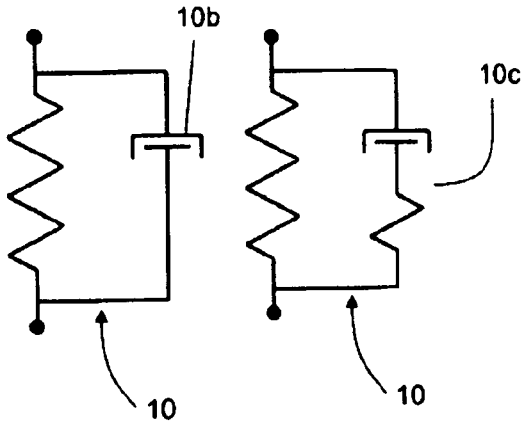

Fig. 1
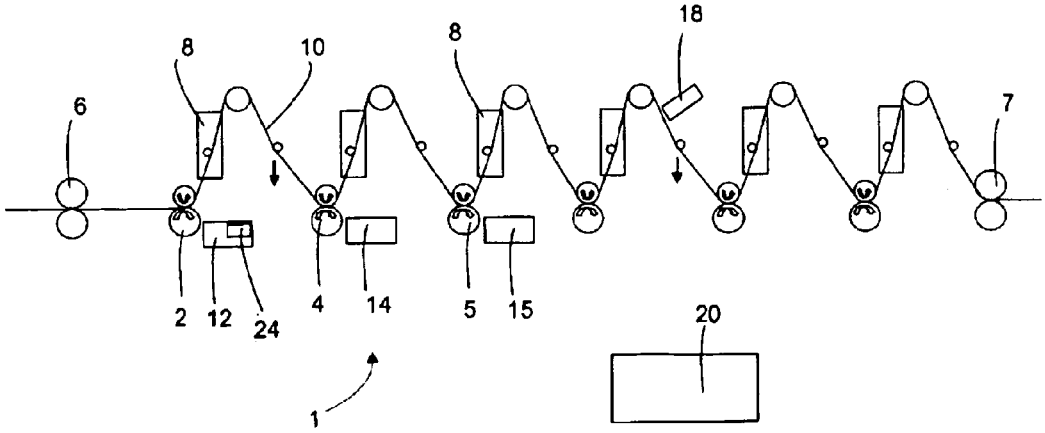
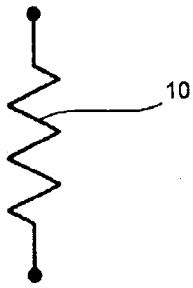
Fig. 2a
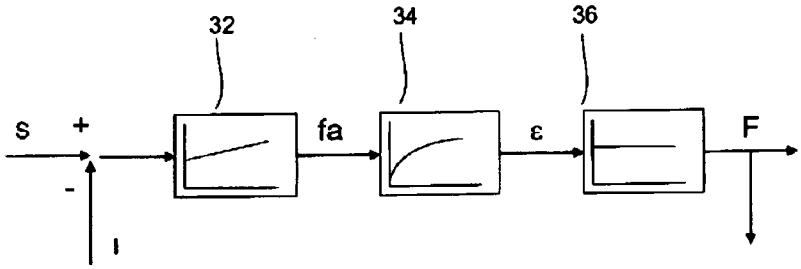
Fig. 2b

WEB-PROCESSING MACHINE AND METHOD FOR THE CONTROL THEREOF

CROSS-REFERENCES TO RELATED APPLICATIONS

The present application is the U.S. national phase under 35 U.S.C. 371 of International Application No. PCT/EP2009/002493 filed Apr. 4, 2009 claiming priority of German Patent Application No. 10 2008 021 445.0 filed Apr. 29, 2008.

BACKGROUND OF THE INVENTION

The present invention relates to a web-processing machine and to a method for open- or closed-loop control thereof. A variety of web-processing machines are known from the existing art, for example printing presses, packaging machines, film stretching machines, or machines for textile treatment. It is known in this context that such machines often comprise a plurality of transport rollers that transport the material to be treated. These rollers are usually equipped with controlled drive systems, and the drive systems in some cases take into account tensions of the material to be processed.

More specifically, web tension control systems or register control systems that proceed, in terms of their controller structure or controller parameter design or parameter adaptation, from a speed-independent modulus of elasticity (hereinafter e-modulus) of the material web, are known. This assumption of a speed-independent modulus of elasticity results in some cases, however, in less than optimal controller parameterizations. DE 10 2005 056 802 A1 discloses a closed-loop control system for the web tension of a material web. In this, control loop parameters of a web tension controller are determined in accordance with a characteristic curve predefinable as a function and/or at multiple support points.

Previously known web tension control systems or register control systems assume that a linear relationship exists between web tension and web elongation.

SUMMARY OF THE INVENTION

The underlying object of the present invention is to improve the control behavior of web tension control systems and register control systems, including at different speeds. This is achieved according to the present invention by the embodiments described herein.

In a method according to the present invention for operating a web-processing machine, a material web is transported with at least one first driven transport roller, and furthermore the material web is also transported with a second transport roller, and furthermore a treatment unit which treats the material web is provided. At least one transport roller comprises a drive device, and at least one drive device is controlled by a control device, said drive device being controlled as a function of elongation properties of the material web. According to the present invention, when taking into account the elongation properties of the material web, a damping or modification, or nonlinearity, of said properties is also taken into account.

A "treatment" of the material web can be understood, for example, as a cutting of the material web, imprinting of the material web, heating of the material web, or the like. While solutions known from the existing art use as their basis a linear relationship between web tension and web elongation, i.e. are based at most on an elastic elongation (or constant moduli of elasticity), the present invention proposes also to take into account any nonlinear elongations, as well as plastic deformations e.g. in the form of flow of the material web.

The existing art furthermore takes into account only a time-independent elongation behavior of the web, i.e. the basis is an ideal Hookean elongation without any damping behavior. The result is that damping of the material web is not taken into account in the identification or adaptation of control parameters or controller parameters, i.e. no consideration is given to time constants that are introduced by the material and that have an effect in particular at higher treatment speeds.

According to the present invention, the control system also takes into account the material behavior, in the manner of a damped spring. The material behavior of the material web (the parameters for a damped spring) is preferably determined directly in the printing press.

In other words, the damping behavior of the material web is taken into account in the design or adaptation of the controller parameters, and speed-dependent adaptation is performed.

In the preferred method, values or characteristic curves stored in a memory device are used to control the drive device. These characteristic curves can result from functional correlations, but it would also be possible to store parameter sets having parameters associated with one another. It is possible in this context for corresponding controller parameters to be optimized in speed-dependent fashion by storing, in the control system, previously calculated speed-dependent characteristic curves for the control parameters or controller parameters. This enables very fast reaction to the varying behavior of the web being processed. It is also possible for the material behavior of the web being processed to be stored in the control system in damping-dependent fashion, such that control parameters or controller parameters can be identified or adapted, preferably online, from these stored material behaviors.

It would also be possible to store the material behavior in the control system as a speed-dependent characteristic curve. With this preferred method, at least one characteristic curve is therefore a speed-dependent characteristic curve.

In a further preferred method, a modulus of elasticity of at least one region of the material web is determined as a function of a transport speed of the material web. This preferred method is based on the recognition that the modulus of elasticity can also change as a function of the transport speed and thus the treatment duration for the material.

The "elongation properties" of the material web are understood, in particular, as the aforementioned modulus of elasticity, or variables resulting from that modulus of elasticity.

Preferably at least one physical variable is taken into account when identifying the elongation properties (or spring constants when identifying the control/controller parameters), which variable is preferably selected from a group of physical variables that contains a temperature of the material, an ambient temperature, a moisture level of the material, a relative humidity of the environment, combinations thereof, or the like.

It is particularly helpful, for an exact evaluation of the elongation properties, to take into account several of the aforesaid properties, for example both the temperature of the material and a transport speed of the material.

In a further preferred method, nonlinear elongation properties or effects of the material web are taken into account when identifying the elongation properties. Particularly preferably, the aforesaid properties, and in particular a temperature influence, are also taken into account when determining a time constant of the material behavior. It is also possible in this context to use in the method observation devices that further optimize the controller design and also better adapt the underlying material model.

In general, the web can be made of a very wide variety of materials, for example paper, textile, paperboard, film, in particular plastic film and/or metal foil, rubber, or the like. The machine types are, as mentioned above, machines such as rotary printing presses, gravure printing presses, package printing machines, processing machines such as, for example, envelope machines, film stretching machines, packaging machines, and the like. These are by preference web-processing machines having long web travels, which in particular comprise a plurality of rollers or shafts or other transport devices.

Examples of the aforementioned nonlinear elongation properties can be, for example, a plastic deformation or a nonlinear elongation characteristic curve.

In a further preferred method, at least one physical property of the material web is determined by means of a measurement device, and the measurement device outputs at least one value that is characteristic of the physical property of the material web, said value being taken into account when identifying the elongation properties of the material web. This means that, for example, properties determined online, for example a force acting on the material web, are identified and are in turn taken into account when identifying the elongation properties of the material web. The aforementioned characteristic curves, which allocate specific physical properties or, in particular, moduli of elasticity, to specific elongation states, can be used for this purpose.

In a further preferred method, at least one physical property of the drive device is determined by means of a measurement device, and the measurement device outputs at least one value that is characteristic of the physical property of the drive device, said value being taken into account when identifying the elongation properties of the material web. In this case, for example, a torque sensor that determines the torque of a drive device can be provided. The result is that the material behavior in particular, i.e. the parameters for the damped spring, is determined directly in the printing press, for example by observation of the torque. With the procedure described above, the measurement can be determined directly via force measurement devices such as load cells. Here as well, therefore, the control system takes the material behavior into account as a damped spring.

The identification of dynamic parameters of the material web is preferably carried out with the aid of the drive system. The "dynamic parameters" are understood here in particular as the modulus of elasticity, damping properties, and/or plastic deformations. This can be accomplished by means of a load cell and position difference, or using variables internal to the drive, in particular torque setpoint, actual torque value, and position difference.

The present invention is furthermore directed toward a web-processing machine having at least one first driven transport roller that transports a material web, at least one second transport roller that transports the material web, and at least one treatment unit that treats the web, such that at least one transport roller comprises a drive device; and toward a control device that controls the drive device, the control device being configured in such a way that it controls the drive device as a function of elongation properties of the material web.

According to the present invention, the control device is configured in such a way that when taking into account the elongation properties of the material web, it also takes into account a damping of those elongation properties. The second transport roller is preferably also driven, and comprises a second drive device. Particularly preferably in this context, the second drive device is also controlled by the control device, and here again the control device takes into account damping properties of the material web. Particularly preferably, a plurality of drive devices for rollers or other transport units are controlled, the basis in each case being the elongation properties of the material web.

In the system or machine according to the present invention as well, the elongation behavior of the material web is not stipulated as a constant, but instead changes in those elongation properties, and in particular in the modulus of elasticity, are likewise taken into account in the context of open- or closed-loop control.

In a preferred embodiment, the machine comprises a measurement device that determines at least one physical property of the material web. These physical properties can be, for example, a tension state of the material web or of a region of the material web that is measured, for example, by way of load cells. It would furthermore be possible to determine a temperature of the material web itself or also of the environment. Lastly, it is preferably also conceivable for multiple measurement devices to be present which determine multiple physical properties of the material web or of the environment, and for all these determined values to be taken into account when controlling the drive device or devices.

In a preferred embodiment, the machine comprises a measurement device that determines a physical property of the drive device. It would be possible in this fashion, for example, to determine an (if applicable, even local) tension state of the material web from a torque of the drive device.

The present invention is furthermore directed toward the use of a method described above, or of a web-processing machine described above, for rotary printing presses, gravure printing presses, textile printing machines, film stretching machines, and/or textile treating machines. Lastly, the present invention is also directed to a computer program for controlling a machine of the kind described above or for carrying out a method of the kind described above.

BRIEF DESCRIPTION OF THE DRAWING VIEWS

Figure 3B:
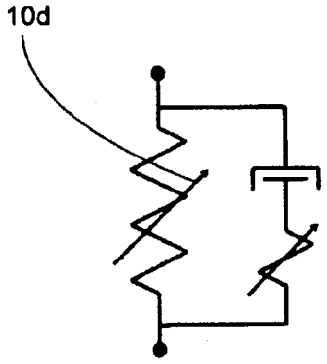
Figure 3C:
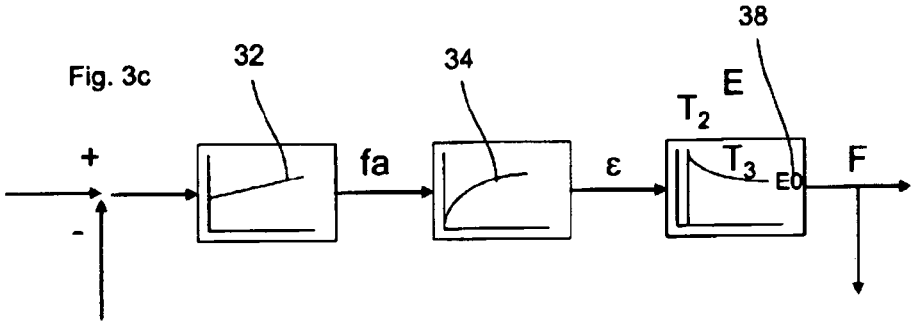

Further advantages and embodiments are evident from the appended drawings, in which:

FIG. 1 schematically depicts a web-processing machine according to the present invention;

FIG. 2*a* depicts, for illustration, the manner in which elongation properties are identified in the existing art;

FIG. 2*b* is a block diagram to illustrate the existing art;

FIG. 3*a* is a depiction relating to identification according to the present invention of the elongation properties;

FIG. 3*b* is a further depiction to illustrate the identification of elongation properties;

FIG. 3*c* is a block diagram to illustrate the method according to the present invention.

DETAILED DESCRIPTION OF THE INVENTION

FIG. 1 schematically depicts a web-processing machine. This machine comprises a plurality of rollers 2, 4, 5 that convey a material web 10 and (in this case) also treat it. Provided in addition are treatment units 8 that each perform a specific operation on the material web, for example drying the web. Be it noted that the transport rollers can also implement treatment functions, and that the transport rollers and treatment units are therefore not necessarily separate devices.

The individual rollers or shafts 2, 4, 5 are driven by drive units 12, 14, and 15. These individual drive devices 12, 14, and 15 are controlled in open- or closed-loop fashion with the aid of a control device 20. In particular, the individual drives are controlled in such a way that the tensions acting on material web 10 are not excessive.

Reference character 24 refers to a sensor device that measures a physical property of the drive, for example a torque, a current, a voltage, or the like. Reference character 18 refers to a further measurement device that determines a property of the material web, for example a temperature of the material web, a moisture level of the material web, or also a tension state of the material web.

As mentioned above, the subject matter of the present invention can be used in the context of web tension control and/or register control in a web-processing printing press or processing machine. In the case of the machine shown in FIG. 1, firstly the material web is conveyed into the machine, and then the material web is guided in machine 1 by way of the aforesaid web transport rollers, for example by an infeed mechanism 6 and an outfeed mechanism 7.

Treatment is accomplished, as mentioned above, by treatment units 8 or by their processing shafts, and, as mentioned, the individual rollers 2, 4, 5 or their drives are controlled by means of a web tension control system or web transport control system. The aforementioned web treatment machines or treatment units are usually controlled by means of a register control system. It is preferably also possible for the treatment units to be controlled in open- or closed-loop fashion using properties of the material web. Reference character 20 refers to a control device for controlling the drive device or devices. In addition, control device 20 can also control the individual treatment units 8.

FIG. 2*a* is a depiction to illustrate methods, known from the existing art, for taking into account properties of the material web. The control behavior principles known from the existing art are depicted, although this behavior also applies to other types of controller, such as register controllers. In this context, as illustrated by FIG. 2*a*, web elongation is assumed to be constant, i.e. the basic model for the web is a Hookean spring whose modulus of elasticity remains constant regardless of elongation and also regardless of other coefficients, i.e. a linear relationship exists between web tension and web elongation.

FIG. 2*b* is an illustration to depict the control behavior. Firstly, a system deviation between a web tension setpoint S and an actual web tension value I is inputted into a web tension controller 32. This web tension controller, which is usually embodied as a PI controller, outputs e.g. a fine adjustment value fa, and thereby adjusts the speed of the web transport rollers.

The controlled system of the material web simulates a change in speed with the aid of an exponential function whose time constant is based on L/v, where L is the length of the material web and v the material web speed. A corresponding control element is labeled here with reference character 34. The output of this aforesaid exponential function is in turn the web elongation. In the existing art, the web tension F is equal to the web elongation multiplied by the spring constant (assumed to be constant), an identification unit 36 in turn being provided here.

In the existing art, control is optimized using the aforementioned approximated PT1 element 34 whose time constant is a function of L/v. As mentioned above, the material is assumed to have a linear modulus of elasticity.

In addition, in the existing art a compensation is applied to the time constant T1 of the PT1 element (proportional element with time constant) of the controlled system, by means of a PI controller 32. In this case the controlled system is understood as $$\frac{Kp}{1+s*T_1}$$

where $K_p$ denotes the P gain of PT1 element 34 and also the P gain of the modulus of elasticity.

The register controllers influence primarily the treatment units, and therefore do not directly control web tension. These register controllers nevertheless often assume a material behavior of the material web. In the context of acceleration processes, for example, the acceleration torques of undriven rollers acting on the material web can be compensated for by incorporating the inertial mass of the undriven rollers or the modulus of elasticity of the material web.

FIG. 3*a* is an illustration of the method according to the present invention. Whereas in the method of the existing art the material web is assumed to be an ideal Hookean spring, as shown in FIG. 2*a*, the present invention proposes to take into account a damping behavior of that spring, illustrated by the symbol 10*b*. The material or material web is thus assumed to be a damped spring. FIG. 3*a* shows two simple equivalent circuit diagrams to illustrate damping segments. In addition to the equivalent diagrams shown in FIG. 3*a*, further, more complex equivalent diagrams having damping elements could also be assumed. In the right-hand part of FIG. 3*a*, a resilient damping system 10*c* is shown as a damping system.

It would furthermore also be possible to assume nonlinear spring constants, so that, for example, plastic deformation effects are thereby taken into account. FIG. 3*b* illustrates a corresponding equivalent circuit diagram in which the nonlinearity is indicated by symbol 10*c*. The web tension is thus understood here as a nonlinear, damped Hookean spring.

Taking the damping behavior as a basis, what results in terms of processing of the values is the depiction in FIG. 3*c*. Here as well, similarly to the case of the diagram shown in FIG. 2*b*, setpoints and actual values S, I are inputted, and fine tuning is outputted. In this case as well, an exponential function is outputted by PT1 element 34. In contrast to the existing art, however, the modulus of elasticity is no longer regarded as a constant, but instead is considered as a function of multiple variables T2, T3. In this case the material therefore no longer participates (as in the case of FIG. 2*b*) as a P element, but instead as a PDT-1 element 38 (proportional-differential element with first-order delay).

The control system is thus no longer based, as presented above, on a PT1 behavior of the controlled system with the above correlation; instead it incorporates the modulus of elasticity as PDT1:

$$E_0*\frac{1+s*T_2}{1+s*T_3}$$

where T2 is a constant value that takes into account the discontinuity in the context of a change at the input. More precisely, it takes into account the discontinuity that is depicted in the diagram of element 38 between the value E0 and the maximum value of the function.

T3 is a constant value that, in particular, is independent of the speed of the material web. This value is constant as long as the production parameters, such as heat or cooling, remain unchanged. This results in an overall system behavior as defined by the following correlation:

$$\frac{Kp \cdot E_0}{1 + s * T_1} \cdot \frac{1 + s * T_2}{1 + s * T_3}$$

As mentioned above, the value T3 is not speed-dependent. This means that at low material web speeds, T1, which contains the speed in the denominator, is dominant, and at high material web speeds the T3 term is dominant. T3 becomes dominant at higher speeds because T1 becomes increasingly small as a function of speed. This must also be taken into account in the design of the controller.

The control loop presented here by way of example for the web tension control system can preferably also be transferred to the register control system for the treatment units. A linkage between web tension and register is preferably provided; the result is that the time constant T3 introduced by the material, and this linkage, must be taken into account in the register control operation, and the control parameters must be correspondingly adapted.

There are multiple possibilities for identifying the aforesaid time constant T3. On the one hand it is possible to measure the time constant T3 using a separate specific measuring device. It is furthermore possible to measure the time constant T3 by measurement in the machine, by means of the change in elongation e.g. at rest, and by observing the drive torques that occur and/or the web tension measurement results. For the latter measurement, load cells can be present in order to measure the web tension. It is also possible to identify the time constant T3 in the machine by observing the process parameters.

It is furthermore possible to subdivide the material or its properties into multiple components and to take these into account in turn in the controller design. Firstly a plastic component can be assumed, although this is meaningful only when relaxation occurs during the treatment process. Nonlinearities can furthermore be taken into account, and additionally (as depicted in the above circuit diagram shown in FIG. 3*a*) a damping.

Temperature and cooling are also optionally taken into account in the determination of constants T2 and T3; temperature sensors can be used for this, for example.

It is also possible to output an approximation for an overall time constant. In the existing art, the I component of the controller compensates for the PT1 system approximated as time constant T1. The time constant T3 that, as set forth above, becomes dominant at higher speed must now additionally be taken into account in the controller design. This was ensured previously by adapting a specific integral action time Tn of a PI controller as a function of T1. In this preferred variant, it is proposed to adapt Tn as a function of T1 and T3. It is possible in this context to assume a time constant $$T_{Res} = T1 + T3$$

resulting from this.

It is also proposed in the context of the invention to identify the controllers and controller parameters online on the basis of an assumed material model, which can be a linear and a nonlinear model. The invention becomes especially suitable when applied in web machines with highly damping-affected materials, for example plastic films or textiles.

All the features disclosed in the Application documents are claimed as essential to the invention to the extent they are novel, individually or in combination, with respect to the existing art.

| LIST OF REFERENCE CHARACTERS | |
|---|---|
| 2, 4, 5 | Rollers/printing units |
| 6 | Infeed mechanism |
| 7 | Outfeed mechanism |
| 8 | Treatment units |
| 10 | Material web |
| 10b, 10c, 10d | Symbols |
| 12, 14 | Drive devices |
| 18 | Measurement device |
| 20 | Control device |
| 24 | Sensor device |
| 32 | Web tension controller |
| 34 | Control element |
| 36 | Control unit |
| F | Web tension |
| T1, T2, T3 | Time constants |

The invention claimed is:

1. A method for operating a web-processing machine having at least one first driven transport roller (2) that transports a material web (10), at least one second transport roller (4) that transports the material web (10), and at least one treatment unit (8) that treats the web, at least one of the transport rollers (2, 4) comprising a drive device (12, 14) controlled by a control device (20), and control of said drive device (12) being accomplished as a function of elongation properties of the material web (10), wherein when taking into account the elongation properties of the material web (10), a damping of said elongation properties is also taken into account by the control device (20).

2. The method according to claim 1, wherein characteristic curves stored in a memory device are used by the control device (20) to control the drive device.

3. The method according to claim 2, wherein at least one of the characteristic curves is a speed-dependent characteristic curve.

4. The method according to claim 1, wherein a modulus of elasticity of at least a region of the material web (10) is determined as a function of a transport speed of the material web (10).

5. The method according to claim 1, wherein at least one physical variable, which is selected from a group of physical variables consisting of a temperature of the material, an ambient temperature, a moisture level of the material, and a relative humidity of the environment, is taken into account when identifying the elongation properties.

6. The method according to claim 1, wherein nonlinear elongation properties of the material web are taken into account when identifying the elongation properties.

7. The method according to claim 1, wherein at least one physical property of the material web (10) is determined by means of a measurement device (18), and the measurement device outputs at least one value that is characteristic of the physical property of the material web, said value being taken into account when identifying the elongation properties of the material web (10).

8. The method according to claim 1, wherein at least one physical property of the drive device (12) is determined by means of a measurement device (24), and the measurement device outputs at least one value that is characteristic of the physical property of the drive device, said value being taken into account when identifying the elongation properties of the material web (10).

9. The method according to claim 8, wherein at least one physical property of the material web (10) is determined by means of a further measurement device (18), wherein the further measurement device outputs a value that is characteristic of the physical property of the material web, and said value is taken into account when identifying the elongation properties of the material web (10).

10. The method according to claim 1, wherein control of said treatment unit (8) occurs as a function of elongation properties of the material web (10).

11. The method according to claim 1, wherein an identification of dynamic parameters of the material web (10) is carried out with the aid of the drive device.

12. A web-processing machine (1) comprising:

at least one first driven transport roller (2) that transports a material web (10), at least one second transport roller (4) that transports the material web (10), and at least one treatment unit (8) that treats the material web (10), wherein at least one of the first driven transport roller (2) and the second transport roller (4) includes a drive device (12, 14);

a control device (20) that controls the drive device (12, 14), the control device being configured to control the drive device (12, 14) as a function of elongation properties of the material web (10), wherein the control device (20) is further configured to take into account a damping of said elongation properties of the material web (10) when taking into account the elongation properties.

13. The web-processing machine (1) according to claim 12, wherein the machine comprises a measurement device (18) that determines a physical property of the material web (10).

14. The web-processing machine (1) according to claim 12, wherein the machine (1) comprises at least one measurement device (24) that determines a physical property of the drive device (12, 14).

15. The web-processing machine according to claim 12, wherein the web-processing machine is selected from a group of machines consisting of rotary printing presses, gravure printing presses, textile printing machines, film stretching machines, and textile treating machines.

16. A computer program product embodied on a non-transitory computer readable medium, the computer program product being operable to cause a data processing control apparatus to control a drive device which is part of a web processing machine having at least one first driven transport roller (2) that transports a material web (10), at least one second transport roller (4) that transports the material web (10) and at least one treatment unit (8) that treats the web, at least one of the transport rollers (2,4) comprising said drive device (12,14), wherein control of said drive device is accomplished as a function of elongation properties of the material web, and wherein when taking into account the elongation properties of the material web (10), a damping of said elongation properties is also taken into account by the data processing control apparatus.

* * * * *

UNITED STATES PATENT AND TRADEMARK OFFICE

CERTIFICATE OF CORRECTION

PATENT NO. : 8,512,609 B2
APPLICATION NO. : 12/989768
DATED : August 20, 2013
INVENTOR(S) : Schnabel et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 183 days.

Signed and Sealed this
Fifteenth Day of September, 2015

Michelle K. Lee

Michelle K. Lee
*Director of the United States Patent and Trademark Office*